US008262964B2

(12) United States Patent
Bernard et al.

(10) Patent No.: US 8,262,964 B2
(45) Date of Patent: Sep. 11, 2012

(54) REFRACTORY ALLOY, FIBRE-FORMING PLATE AND METHOD FOR PRODUCING MINERAL WOOL

(75) Inventors: Jean-Luc Bernard, Clermont (FR); Patrice Berthod, Pont-a-Mousson (FR); Ludovic Hericher, Chalon sur Saone (FR); Christophe Liebaut, Saint-Jean de Vaux (FR); Sylvain Michon, Chalon sur Saone (FR)

(73) Assignees: Saint-Gobain Isover, Courbevoie (FR); Saint-Gobain Seva, Chalon sur Saone (FR)

( * ) Notice: Subject to any disclaimer, the term of this patent is extended or adjusted under 35 U.S.C. 154(b) by 269 days.

(21) Appl. No.: 12/744,496

(22) PCT Filed: Nov. 27, 2008

(86) PCT No.: PCT/FR2008/052140

§ 371 (c)(1),
(2), (4) Date: May 25, 2010

(87) PCT Pub. No.: WO2009/071847

PCT Pub. Date: Jun. 11, 2009

(65) Prior Publication Data

US 2010/0244310 A1 Sep. 30, 2010

(30) Foreign Application Priority Data

Nov. 30, 2007 (FR) ..... 0759451

(51) Int. Cl.
*B29C 47/00* (2006.01)

(52) U.S. Cl. ..... 264/211.1; 420/436; 420/439; 425/72.2

(58) Field of Classification Search ..... 420/436, 420/439; 264/211.1; 425/72.2
See application file for complete search history.

(56) References Cited

U.S. PATENT DOCUMENTS

| | | | | |
|---|---|---|---|---|
| 3,881,918 | A * | 5/1975 | Costin et al. | 420/440 |
| 4,820,324 | A | 4/1989 | Gaul et al. | |
| 6,266,979 | B1 * | 7/2001 | Johnson et al. | 65/302 |
| 6,361,836 | B1 * | 3/2002 | Johnson | 427/534 |
| 2003/0221756 | A1 | 12/2003 | Berthod et al. | |
| 2007/0107811 | A1 | 5/2007 | Bernard et al. | |
| 2007/0292303 | A1 | 12/2007 | Berthod et al. | |

FOREIGN PATENT DOCUMENTS

| | | |
|---|---|---|
| JP | 2002-256363 | 9/2002 |
| WO | WO 2005/052208 A1 | 6/2005 |

OTHER PUBLICATIONS

Iqbal Ahmad, et al., "Reinforced Cobalt Alloy Composite for Turbine Blade Application", Sample Quarterly, vol. 8, No. 3, XP009106271, Jan. 1, 1977, pp. 38-49.
William F. Collopy, "Powders Add Flexibility to Hardfacing, Cut Costs", Metal Progress, vol. 121, No. 6, XP009106171, May 1, 1982, pp. 47-49.
U.S. Appl. No. 09/308,650, Aug. 6, 1999, Berthod, et al.

* cited by examiner

*Primary Examiner* — Joseph Del Sole
*Assistant Examiner* — James Sanders
(74) *Attorney, Agent, or Firm* — Oblon, Spivak, McClelland, Maier & Neustadt, L.L.P.

(57) ABSTRACT

An alloy, characterized in that it contains the following elements (the proportions being indicated in percentages by weight of the alloy):

| | |
|---|---|
| Cr: | 23 to 34% |
| Ti: | 0.2 to 5% |
| Ta: | 0.5 to 7% |
| C: | 0.2 to 1.2% |
| Ni: | less than 5% |
| Fe: | less than 3% |
| Si: | less than 1% |
| Mn: | less than 0.5%, |

the balance consisting of cobalt and inevitable impurities.
An article for the manufacture of mineral wool, especially fiberizing spinner, made of such an alloy.

17 Claims, No Drawings

REFRACTORY ALLOY, FIBRE-FORMING PLATE AND METHOD FOR PRODUCING MINERAL WOOL

The present invention relates to a metal alloy for use at very high temperature, especially one that can be used in a process for manufacturing mineral wool by fiberizing a molten mineral composition, or more generally for the production of tools endowed with high-temperature mechanical strength in an oxidizing environment, such as molten glass, and to cobalt-based alloys that can be used at high temperature, especially for producing articles for the hot smelting and/or conversion of glass or any other mineral material, such as components of machines for manufacturing mineral wool.

One fiberizing technique, called the internal centrifugation process, consists in letting liquid glass fall continuously into an assembly of axisymmetric parts rotating with a very high rotation speed about their vertical axis. One key part, called the "spinner", receives the glass against a wall called the "band" which is pierced by holes through which the glass flows under the effect of the centrifugal force, to escape from all parts thereof in the form of molten filaments. An annular burner located above the outside of the spinner, which produces a descending stream of gas hugging the outer wall of the band, deflects these filaments downward, attenuating them. The filaments then "solidify" in the form of glass wool.

The spinner is a fiberizing tool that is highly stressed thermally (heat shocks during startup and shutdown procedures, and, during steady use, a temperature gradient along the part), mechanically (centrifugal force, and erosion due to the flow of the glass) and chemically (oxidation and corrosion by the molten glass, and by the hot gases output by the burner around the spinner). Its main modes of deterioration are the following: hot creep deformation of the vertical walls; appearance of horizontal or vertical cracks; and erosive wear of the fiberizing orifices, which require, purely and simply, the replacement of the components. Their constituent material must therefore be resistant for a production time long enough to remain compatible with the technical and economic constraints of the process. For this purpose, materials endowed with a certain ductility, creep resistance and corrosion and/or oxidation resistance are sought.

Various known materials for producing these tools are nickel-based or cobalt-based superalloys strengthened by the precipitation of carbides. Particularly refractory alloys are based on chromium, cobalt (a refractory element that provides the matrix of the alloy with improved high-temperature intrinsic mechanical strength) and nickel (in order to stabilize the face-centered cubic crystal lattice of Co).

Thus, WO-A-99/16919 discloses a cobalt-based alloy having improved high-temperature mechanical properties, comprising the following elements (in percentages by weight of the alloy):

| | |
|---|---|
| Cr: | 26 to 34% |
| Ni: | 6 to 12% |
| W: | 4 to 8% |
| Ta: | 2 to 4% |
| C: | 0.2 to 0.5% |
| Fe: | less than 3% |
| Si: | less than 1% |
| Mn: | less than 0.5% |
| Zr: | less than 0.1%, |

the balance consisting of cobalt and inevitable impurities, the tantalum/carbon molar ratio being around 0.4 to 1.

The selection of the carbon and tantalum contents is intended to form, in the alloy, a dense but discontinuous network of intergranular carbides consisting essentially of chromium carbides, in the form of $Cr_7C_3$ and $(Cr,W)_{23}C_6$, and tantalum carbides TaC. This selection gives the alloy improved high-temperature mechanical and oxidation resistance properties, allowing a molten glass whose temperature is 1080° C. to be fiberized.

Also known, from WO 01/90429, are cobalt-based alloys that can be employed at even higher temperatures, these alloys presenting a good compromise between mechanical strength and oxidation resistance above 1100° C., thanks to a microstructure whose intergranular zones are rich in tantalum carbide precipitates. On the one hand, these carbides act as a mechanical reinforcement, opposing intergranular creep at very high temperature, and, on the other hand, they have an effect on the oxidation behavior owing to their oxidation to $Ta_2O_5$, which forms oxides entirely filling the previous volume of TaC carbides, preventing the penetration of the aggressive medium (liquid glass, hot gas) into the intergranular spaces.

More recently, application WO 2005/052208 has disclosed an alloy having high mechanical strength at high temperature in an oxidizing medium, based on a cobalt matrix stabilized by nickel and containing chromium, reinforced by the precipitation of carbides, especially titanium and tantalum carbides.

The alloys described in the abovementioned patent applications may in particular be used under industrial conditions for fiberizing novel glass compositions, particularly basaltic compositions, the melting point of which is above that of the compositions conventionally used in glass wool production processes. Such compositions are described in the rest of the present description.

For example, a fiberizing spinner made from the alloy described in example 6 of WO 2005/052208 can withstand relatively long periods at molten glass temperatures of around 1200 to 1240° C., corresponding to a metal temperature of between 1160 and 1210° C., depending on the profile of the spinner.

However, the industrial production of basaltic glass fibers is of economic benefit only if the mechanical strength of the spinner, and therefore of the constituent alloy, is sufficient at the abovementioned fiberizing temperatures. In particular, the lifetime of the spinner within the fiberizing installation, which is one of the most important cost factors in the overall fiberizing process, will be longer the higher the mechanical strength of the alloy, combined with its corrosion resistance.

The object of the present invention is to provide further improved alloys, the high-temperature mechanical strength of which is increased, enabling the metal to work at a temperature possibly up to 1200° C., or even at higher temperatures, said alloys having an improved lifetime under such fiberizing conditions.

In particular, one subject of the present invention is cobalt-based alloy also comprising chromium and carbon, which contains the following elements (the proportions being indicated in percentages by weight of the alloy):

| | |
|---|---|
| Cr: | 23 to 34% |
| Ti: | 0.2 to 5% |
| Ta: | 0.5 to 7% |
| C: | 0.2 to 1.2% |
| Ni: | less than 5% |
| Fe: | less than 3% |

-continued

| | |
|---|---|
| Si: | less than 1% |
| Mn: | less than 0.5%, |

the balance consisting of cobalt and inevitable impurities.

The alloy according to the present invention differs from the alloys incorporating Ti and Ta carbides described in the application WO 2005/052208 (see in particular Examples 6 and 7) in that the nickel content is substantially lower than those described in that publication (8.7% by weight in the case of the alloys of examples 6 and 7). Up until now, it was believed that the presence of such an amount of nickel was necessary in order to extend the temperature stability range of the face-centered cubic crystal structure of the cobalt matrix (see for example page 7, lines 18-21 of WO 2005/052208 or page 8, lines 29-32 and page 17, lines 25-30 of WO 2001/90429. Furthermore, trials carried out on the alloys of application WO 99/16919 have shown that the presence of a substantial amount of nickel appears to be preferable in order to limit oxidation of such alloys during their use in a high-temperature fiberizing process.

Unexpectedly, and even to the contrary of what could have been expected, the properties of the alloy compositions according to the present invention, that is to say those having a much lower nickel content than previously described, appear to be superior to those of the alloys described above. In particular, the lifetimes of the spinners obtained from the alloys according to the invention during a high-temperature fiberizing process appear to be very substantially improved.

The reader may refer to the application WO 2005/052208 for a complete description of the advantages and the microstructure present in the alloys according to the present invention. This is because the microstructures of the new alloys, observed in electron microscopy, are essentially almost identical to those already described in the application WO 2005/052208. In particular, mixed tantalum titanium carbides (Ta,Ti)C are observed at the grain boundaries of the alloys, which have an improved high-temperature microstructure—less fragmentation and less rarefaction of the (Ta,Ti)C carbides. Better still, the addition of Ti to the TaC carbides stabilizes the latter at high temperature to such a point that fine secondary (Ta,Ti)C carbides, very useful for intragranular creep resistance, spontaneously precipitate in the matrix (whereas in general secondary precipitates obtained by special heat treatment have more of a tendency to disappear under the same conditions). This high-temperature stability makes these (Ta,Ti)C carbides particularly advantageous.

It is advantageous to favor the (Ta,Ti)C carbides as sole hardening phase, by maintaining a ratio of the atomic content of the sum of the metals (Ta+Ti) to the atomic content of carbon close to 1, but which may be higher, especially around 0.9 to 2. In particular, a slight difference, to below unity, remains permissible in the sense that the few additional carbides that could be generated (chromium carbides) do not impair the set of properties at all temperatures. An advantageous ratio range is generally 0.9 to 1.5.

Carbon is an essential constituent of the alloy, needed to form metal carbide precipitates. In particular, the carbon content directly determines the quantity of carbides present in the alloy. It is at least 0.2% by weight in order to obtain the desired minimum reinforcement, preferably at least 0.6% by weight, but preferably limited to at most 1.2% by weight in order to prevent the alloy from becoming hard and difficult to machine because of too high a density of reinforcements. The lack of ductility of the alloy at such contents prevents an imposed deformation (for example of thermal origin) from being accommodated without fracturing and prevents it from being sufficiently resistant to crack propagation.

As described above, chromium contributes to the intrinsic mechanical strength of the matrix in which it is partly present in solid solution and, in certain cases, also in the form of carbides essentially of the $Cr_{23}C_6$ type with a fine dispersion within the grains, where they provide intragranular creep resistance, or in the form of carbides of the $Cr_7C_3$ or $Cr_{23}C_6$ type present at the grain boundaries, which carbides prevent grains from slipping past one another, and thus also contributing to the intergranular strengthening of the alloy. Chromium contributes to the corrosion resistance, as precursor of chromium oxide that forms a protective layer on the surface exposed to the oxidizing medium. A minimum quantity of chromium is needed to form and maintain this protective layer. However, too high a chromium content is deleterious to both mechanical strength and toughness at high temperatures, as it results in too high a stiffness and too low an elongatability under stress that are incompatible with the high-temperature constraints.

In general, the chromium content of an alloy according to the invention that can be used will be from 23 to 34% by weight, preferably around 26 to 32% by weight, and advantageously about 27 to 30% by weight.

Nickel, present in the alloy in the form of a solid solution with cobalt, is present in an amount of less than 5% by weight of the alloy. Preferably, the amount of nickel present in the alloy is less than 4%, or even less than 3%, or even less than 2% by weight of the alloy. Below 1% by weight of the alloy, below which threshold the Ni is present only in the form of inevitable impurities, excellent spinner lifetimes, hitherto never observed, have also been obtained. The term "inevitable impurities" is understood within the context of the present invention to mean that the nickel is not present intentionally in the composition of the alloy but is introduced in the form of impurities contained in at least one of the main elements of the alloy (or in at least one of the precursors for said main elements).

More generally, the trials carried out by the applicant have shown that nickel is practically always present in the form of inevitable impurities in an amount of at least 0.3% by weight and usually at least 0.5% by weight, or even at least 0.7% by weight. Nickel contents in the alloy of less than 0.3% by weight must however also be considered as falling within the scope of the invention, but the cost resulting from such a purity would then make the cost of the alloy too high to make the fiberizing process commercially viable.

Since titanium is a more standard, and less expensive, element than tantalum, it therefore has less of an adverse effect on the final cost of the alloy. The fact that this element is light may also be an advantage.

A minimum quantity of titanium of 0.2 to 5% by weight of the alloy seems preferable for producing a sufficient quantity of TiC carbides, certainly because of the solubility of titanium in the fcc cobalt matrix. A titanium content of around 0.5 to 4%, especially 0.6 to 3%, seems advantageous. Excellent results have been obtained for alloys having Ti contents of between 0.8 and 2%.

Compared with the alloys described in the application WO 2005/052208, the alloys according to the invention containing mixed tantalum titanium carbides demonstrate an even better high-temperature stability, as will be described below.

The tantalum present in the alloy is partly in solid solution in the cobalt matrix, in which this heavy atom locally distorts the crystal lattice and impedes, or even prevents, the movement of dislocations when the material is under a mechanical load, thus contributing to the intrinsic strength of the matrix.

The minimum tantalum content allowing formation of mixed carbides with the Ti according to the invention is around 0.5%, preferably around 1% and very preferably around 1.5%, or even 2%. The upper limit of the tantalum content may be chosen to be about 7%. The tantalum content is preferably around 2 to 6%, in particular 1.5 to 5%. The tantalum content is very preferably less than 5%, or 4.5% or even 4% and advantageously close to 3. A small quantity of tantalum has two advantages—it substantially reduces the overall cost of the alloy and also makes machining of said alloy easier. The higher the tantalum content, the harder the alloy is, that is to say the more difficult it is to form.

The alloy may contain other elements present in minor quantities or in the form of inevitable impurities. In general, it comprises:

- silicon, as deoxidizing agent for the molten metal during smelting and casting of the alloy, in an amount of less than 1% by weight;
- manganese, also a deoxidizing agent, in an amount of less than 0.5% by weight; and
- iron, in a content of possibly up to 3% by weight without impairing the properties of the material and preferably in a content equal to or less than 2% by weight, for example equal to or less than 1% by weight,
- the cumulative quantity of the other elements introduced as impurities with the essential constituents of the alloy ("inevitable impurities") advantageously representing less than 1% by weight of the composition of the alloy.

The alloys according to the invention are preferably free of Ce, La, B, Y, Dy, Re and other rare earths.

The alloys that can be used according to the invention, which contain highly reactive elements, may be formed by casting, especially by inductive melting in an at least partly inert atmosphere, and by sand mold casting.

The casting may optionally be followed by a heat treatment at a temperature that may be above the fiberizing temperature.

The subject of the invention is also a process for manufacturing an article by casting using the alloys described above as subject matter of the invention.

The process may include at least one cooling step, after the casting and/or after or during a heat treatment, for example by air cooling, especially with a return to ambient temperature.

The alloys according to the invention may be used to manufacture all kinds of parts that are mechanically stressed at high temperature and/or required to operate in an oxidizing or corrosive environment. The subject of the invention is also such articles manufactured from an alloy according to the invention, especially by casting.

Among such applications, mention may in particular be made of the manufacture of articles that can be used for the hot smelting or conversion of glass, for example fiberizing spinners for the manufacture of mineral wool.

Another subject of the invention is therefore a process for manufacturing mineral wool by internal centrifugation, in which a flow of molten mineral material is poured into a fiberizing spinner, the peripheral band of which is perforated by a multitude of holes through which filaments of molten mineral material escape, said filaments then being attenuated into wool through the action of a gas, the temperature of the mineral material in the spinner being at least 1200° C. and the fiberizing spinner being made of an alloy as defined above.

The alloys according to the invention therefore make it possible to fiberize glass, or a similar molten mineral composition, having a liquidus temperature $T_{liq}$ of around 1130° C. or higher, for example 1130 to 1200° C., especially 1170° C. or higher.

In general, these molten mineral compositions may be fiberized within a temperature range (for the molten composition reaching the spinner) of between $T_{liq}$ and $T_{log\ 2.5}$, where $T_{log\ 2.5}$ is the temperature at which the molten composition has a viscosity of $10^{2.5}$ poise (dPa·s), typically around 1200° C. or higher, for example 1240 to 1250° C. or higher.

Among these mineral compositions, it may be preferred to have compositions containing a significant quantity of iron, which compositions are less corrosive with respect to the constituent metal of the fiberizing members.

Thus, the process according to the invention advantageously uses a composition of mineral material that is oxidizing in particular with respect to chromium, capable of repairing or reconstituting the protective $Cr_2O_3$ oxide layer established on the surface. In this regard, it may be preferred to use compositions containing iron essentially in ferric form (the oxide $Fe_2O_3$), especially with a molar ratio of the II and III oxidation states, expressed by the $$\frac{FeO}{FeO + Fe_2O_3}$$

ratio of around 0.1 to 0.3, especially 0.15 to 0.20.

Advantageously, the mineral composition has a high iron content allowing a rapid rate of reconstitution of chromium oxide with an amount of iron oxide (an amount called "total iron", corresponding to the total iron content conventionally expressed in equivalent $Fe_2O_3$ form) of at least 3%, preferably at least 4%, especially around 4 to 12%, in particular at least 5%. Within the above redox range, this corresponds to a content of ferric iron $Fe_2O_3$ alone of at least 2.7%, preferably at least 3.6%.

Such compositions are known, in particular from WO-99/56525, and advantageously comprise the following constituents:

| | |
|---|---|
| $SiO_2$ | 38-52%, preferably 40-48% |
| $Al_2O_3$ | 17-23% |
| $SiO_2 + Al_2O_3$ | 56-75%, preferably 62-72% |
| RO (CaO + MgO) | 9-26%, preferably 12-25% |
| MgO | 4-20%, preferably 7-16% |
| MgO/CaO | ≧0.8, preferably ≧1.0 or ≧1.15 |
| $R_2O$ ($Na_2O + K_2O$) | ≧2% |
| $P_2O_5$ | 0-5% |
| Total iron ($Fe_2O_3$) | ≧1.7%, preferably ≧2% |
| $B_2O_3$ | 0-5% |
| MnO | 0-4% |
| $TiO_2$ | 0-3%. |

Other compositions known from WO-00/17117 prove to be particularly appropriate for the process according to the invention.

They are characterized by the following percentage contents by weight:

| | |
|---|---|
| $SiO_2$ | 39-55%, preferably 40-52% |
| $Al_2O_3$ | 16-27%, preferably 16-25% |
| CaO | 3-35%, preferably 10-25% |
| MgO | 0-15%, preferably 0-10% |
| $Na_2O$ | 0-15%, preferably 6-12% |
| $K_2O$ | 0-15%, preferably 3-12% |
| $R_2O$ ($Na_2O + K_2O$) | 10-17%, preferably 12-17% |
| $P_2O_5$ | 0-3%, preferably 0-2% |
| Total iron ($Fe_2O_3$) | 0-15%, preferably 4-12% |

-continued

| | |
|---|---|
| $B_2O_3$ | 0-8%, preferably 0-4% |
| $TiO_2$ | 0-3%, |

MgO being between 0 and 5%, especially between 0 and 2% when $R_2O \leqq 13.0\%$.

According to one embodiment, the compositions possess iron oxide contents of between 5 and 12%, especially between 5 and 8%. This makes it possible to achieve a fire resistance of the mineral wool blankets.

Although the invention has been described mainly within the context of the manufacture of mineral wool, it may be applied to the glass industry in general for producing furnace components or accessories, bushings, or feeders, especially for the production of textile glass (yarn or strand) and packaging glass.

Outside the glass industry, the invention may apply to the manufacture of a very wide variety of articles when these have to have high mechanical strength in an oxidizing and/or corrosive environment, in particular at high temperature.

In general, these alloys may be used to produce any type of fixed or moving part made of refractory alloy for the operation or running of a high-temperature (above 1200° C.) heat treatment furnace, a heat exchanger or a reactor in the chemical industry. Thus, they may for example be used for hot fan blades, firing supports, furnace-charging equipment, etc. They may also be used to produce any type of resistance heating element intended to operate in a hot oxidizing atmosphere, and to produce turbine components used in engines of land, sea or air transport vehicles, or in any other application not involving vehicles, for example power generating stations.

Thus, a subject of the invention is the use in an oxidizing atmosphere at a temperature of at least 1200° C. of an article made of an alloy as defined above.

The following nonrestrictive examples of the compositions according to the invention or of the processing conditions for the fiberizing spinners according to the invention illustrate the advantages of the present invention.

EXAMPLE 1

Using the technique of inductive melting in an inert (especially argon) atmosphere, a molten charge of the following composition was prepared and then formed by simple casting in a sand mold:

| | |
|---|---|
| Cr: | 27.83% |
| Ni: | 1.33% |
| C: | 0.36% |
| Ta: | 3.08% |
| Ti: | 1.34% |
| Fe: | 2.00% |
| Mn: | <0.5% |
| Si: | <0.3% |
| Zr: | <0.1% |
| sum of other impurities | <1% |

the balance consisting of cobalt.

The casting was followed by a heat treatment comprising a solution phase for 2 hours at 1200° C. and a secondary-carbide precipitation phase for 10 hours at 1000° C., each of these temperature holds ending in an air cooling step down to ambient temperature.

In this way, a 400 mm diameter fiberizing spinner of conventional shape was manufactured.

EXAMPLE 2

A second 400 mm diameter fiberizing spinner, having the same characteristics, was prepared using a manufacturing process identical to example 1 from a molten charge of the following composition:

| | |
|---|---|
| Cr: | 28.84% |
| Ni: | 0.78% |
| C: | 0.41% |
| Ta: | 2.95% |
| Ti: | 1.21% |
| Fe: | 0.66% |
| Mn: | <0.5% |
| Si: | <0.3% |
| Zr: | <0.1% |
| sum of other impurities | <1% |

the balance consisting of cobalt.

EXAMPLE 3

Comparative Example

For comparison, two 400 mm diameter spinners identical in their shape characteristics to the previous ones were produced under the same conditions as in examples 1 and 2 above, but obtained from the alloy composition according to example 6 of WO 2005/052208, namely:

| | |
|---|---|
| Cr: | 28.3% |
| Ni: | 8.7% |
| C: | 0.4% |
| Ta: | 3.0% |
| Ti: | 1.5% |
| Fe: | <2% |
| Mn: | <0.5% |
| Si: | <0.3% |
| Zr: | <0.1% |
| sum of other impurities | <1% |

the balance consisting of cobalt.

The capability of the spinners thus formed was evaluated in the glass wool fiberizing application. More precisely, the spinners were placed on an industrial line for fiberizing a basaltic glass of composition:

| $SiO_2$ | $Al_2O_3$ | Total iron ($Fe_2O_3$) | CaO | MgO | $Na_2O$ | $K_2O$ | Various |
|---|---|---|---|---|---|---|---|
| 45.7 | 19 | 7.7 | 12.6 | 0.3 | 8 | 5.1 | 1 |

This is a relatively oxidizing glass compared with a conventional glass because of its high iron content and a redox of 0.15. Its liquidus temperature is 1140° C.

The spinners were used with two different outputs of 10 and 12.5 tonnes per day until they were stopped, the decision to stop being decided because the spinner was ruined, as indicated by visible deterioration, or because the quality of the fiber produced had become too poor.

Apart from the changes in output, the fiberizing conditions remained identical from one spinner to the other: the temperature of the mineral composition entering the spinner was around 1200 to 1240° C. and the temperature of the metal along the profile of the spinner was between 1160 and 1210° C.

The lifetimes of the spinners, as a function of their operating conditions, are given in Table 1. In this table, for the sake of clarity and to make immediate comparison easier, the lifetimes obtained for the spinners according to the invention (examples 1 and 2) have been put into correspondence with the lifetimes obtained for the reference spinners (example 3) under identical output conditions.

TABLE 1

| Spinner used | Glass output 10 t/d | Glass output 12.5 t/d |
|---|---|---|
| Example 1 spinner | 282 hours | — |
| Example 2 spinner | — | 200 hours |
| Example 3 (comparative) spinners | 229 hours | 151 hours |

Table 1 shows that the spinners according to the present invention always have longer lifetimes under comparable operating conditions.

The solidus temperature of the constituent alloy of the spinners, after they had been used in the above fiberizing process, was then measured using conventional DTA (differential thermal analysis) techniques.

The term "solidus temperature" is understood within the present description to mean the melting point of the alloys at equilibrium. Because of a different analysis method, it should be noted that the values obtained for the solidus temperatures given in Table 2 differ slightly from the values obtained previously in WO 2005/052208. However, the relative differences in melting point between the alloys according to the invention and the reference alloy remain the same, irrespective of the method used.

The results are given in Table 2:

TABLE 2

| Spinner used | Glass output 10 t/d | Glass output 12.5 t/d |
|---|---|---|
| Example 1 spinner alloy | 1345° C. | — |
| Example 2 spinner alloy | — | 1348° C. |
| Example 3 (comparative) spinner alloy | 1334° C. | 1339° C. |

This table shows that the solidus temperature of the alloys according to the invention is approximately more than 10° C. higher than that of the alloys of the prior art in all cases, this being reflected in greater refractoriness. Owing to the relative proximity between the operating temperature of the spinner in the fiberizing process and the melting point of the constituent alloy of the spinner, such an improvement is extremely significant and could by itself justify the superior high-temperature mechanical strength properties as observed in the present alloys.

The high-temperature mechanical strength properties of the alloys of example 1 according to the invention and example 3 according to the prior art were measured in creep resistance tests carried out in three-point bending at 1250° C. under a load of 31 MPa for a time of 200 hours. The tests were carried out for each alloy on a series of parallelepipedal test pieces measuring 30 mm in width by 3 mm in thickness, the load being applied at the mid-point between supports separated by 37 mm. The results are given in Table 3. This table shows the slope of the three-point bending creep curves obtained for each alloy, said slope illustrating the creep deformation rate (in μm/h) of the test piece.

Table 3 summarizes all the results obtained, giving, for each alloy, the average creep rates and the maximum and minimum values observed on the entire series of test pieces.

TABLE 3

| Creep rate in three-point bending (μm/h) | Average value | Minimum value | Maximum value |
|---|---|---|---|
| Example 1 alloy (according to the invention) | 4.1 | 2.8 | 5.7 |
| Example 3 (comparative) alloy | 17.7 | 3.5 | 30.8 |

By comparing the data given in Table 3, it may be seen that the alloy according to the invention has a substantially improved stress creep resistance at high temperature. Combined with the increase in the solidus temperature of the alloys according to the invention, this improvement in creep resistance results in an increase in the lifetime of a spinner manufactured from an alloy according to the invention when it is used on an industrial line for fiberizing a basaltic glass, as mentioned above.

The invention claimed is:

1. An alloy consisting of the following elements by weight of the alloy:

| | |
|---|---|
| Cr: | 23 to 34% |
| Ti: | 0.2 to 5% |
| Ta: | 0.5 to 7% |
| C: | 0.2 to 1.2% |
| Ni: | less than 5% |
| Fe: | less than 3% |
| Si: | less than 1% |
| Mn: | less than 0.5%, and |

the balance cobalt and inevitable impurities.

2. The alloy according to claim 1, having Ni of less than 4% by weight.

3. The alloy according to claim 1, having C of at least 0.2% by weight.

4. The alloy according to claim 1, having the metals Ti and Ta wherein (Ti+Ta)/C is 0.9 to 2 in a molar ratio.

5. The alloy according to claim 1, having titanium of 0.5 to 4% by weight.

6. The alloy according to claim 1, wherein the tantalum content is in a range of from 1 to 7%.

7. The alloy according to claim 1 wherein the chromium content is in a range of from 26 to 32%.

8. An article for manufacturing a mineral wool, comprising an alloy according to claim 1.

9. A fiberizing spinner for manufacturing a mineral wool, comprising an alloy according to claim 1.

10. A process for manufacturing a mineral wool by internal centrifugation, comprising pouring a flow of molten mineral material into a fiberizing spinner according to claim 9, further comprising perforating a peripheral band by a multitude of holes through which filaments of molten mineral material escape, wherein said filaments are attenuated into the wool by a gas, and a temperature of the mineral material in the spinner is at least 1200° C.

11. The process according to claim 10, wherein the molten mineral material has a liquidus temperature of around 1130° C. or higher.

12. The alloy according to claim 1, having Ni of less than 2% by weight.

13. The alloy according to claim 1, having C of at least 0.6% by weight.

14. The alloy according to claim 1, having the (Ti+Ta)/C of 0.9 to 0.15.

15. The alloy according to claim 1, having titanium of 0.6 to 3% by weight.

16. The alloy according to claim 1, wherein the tantalum content is in a range of from 2 to 6%.

17. the alloy according to claim 1, wherein the chromium content is in a range of from 27% to 30%.

* * * * *